US007866847B2

(12) United States Patent
Zheng

(10) Patent No.: US 7,866,847 B2
(45) Date of Patent: Jan. 11, 2011

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 120 days.

(21) Appl. No.: 12/409,503

(22) Filed: Mar. 24, 2009

(65) Prior Publication Data

US 2010/0046225 A1 Feb. 25, 2010

(30) Foreign Application Priority Data

Aug. 19, 2008 (CN) ..... 2008 1 0304034

(51) Int. Cl.
*F21S 4/00* (2006.01)
*F21V 21/00* (2006.01)

(52) U.S. Cl. ..... 362/249.03; 362/249.02; 362/43; 362/508; 362/523; 362/545; 362/220; 362/230; 362/231

(58) Field of Classification Search ..... 362/249.02, 362/249.03, 249.09, 249.1, 249.13, 612, 362/555, 39, 40, 41, 43, 508, 512, 523, 544, 362/543, 545, 187, 188, 220, 230, 231, 268, 362/269, 311.02
See application file for complete search history.

(56) References Cited

U.S. PATENT DOCUMENTS

| | | | | |
|---|---|---|---|---|
| 6,250,774 | B1 * | 6/2001 | Begemann et al. | 362/231 |
| 6,525,668 | B1 * | 2/2003 | Petrick | 340/815.45 |
| 7,014,337 | B2 * | 3/2006 | Chen | 362/240 |
| 2003/0043594 | A1 * | 3/2003 | Hsing Chen et al. | 362/555 |

* cited by examiner

*Primary Examiner*—Sandra L O Shea
*Assistant Examiner*—Danielle Allen
(74) *Attorney, Agent, or Firm*—Frank R. Niranjan

(57) ABSTRACT

An LED lamp includes a frame having a bottom surface, a plurality of heat sinks, and a plurality of LED modules. Each of the heat sinks has an engaging surface defined at an acute angle with respect to the bottom surface of the frame. Each of the LED modules is attached on the engaging surface of the heat sink. The heat sinks are rotatable relative to the frame to adjust the angle of the engaging surface of the heat sinks with respect to the bottom surface of the frame, providing variable area and intensity of illumination.

13 Claims, 6 Drawing Sheets

LED LAMP

BACKGROUND OF THE DISCLOSURE

1. Field of the Disclosure

The disclosure relates to light emitting diodes (LEDs) and, more particularly, to an LED lamp providing adjustable illumination area and intensity.

2. Description of Related Art

The technology of light emitting diodes has been rapidly developed in recent years, allowing expansion of application from indicators to include illumination. With the features of long-term reliability, environment friendliness and low power consumption, the LED is viewed as a promising alternative for recent lighting products.

A related LED lamp includes a heat sink and a plurality of LED modules having LEDs, attached to an outer surface of the heat sink to allow dissipation of heat generated by the LEDs. The outer surface of the heat sink is generally planar with the LEDs arranged closely. However, such LED mounting limits the size of the illumination area and restricts adjustability thereof.

What is needed, therefore, is an LED lamp providing an adjustable illumination area, thereby overcoming the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE DISCLOSURE

Figure 1:
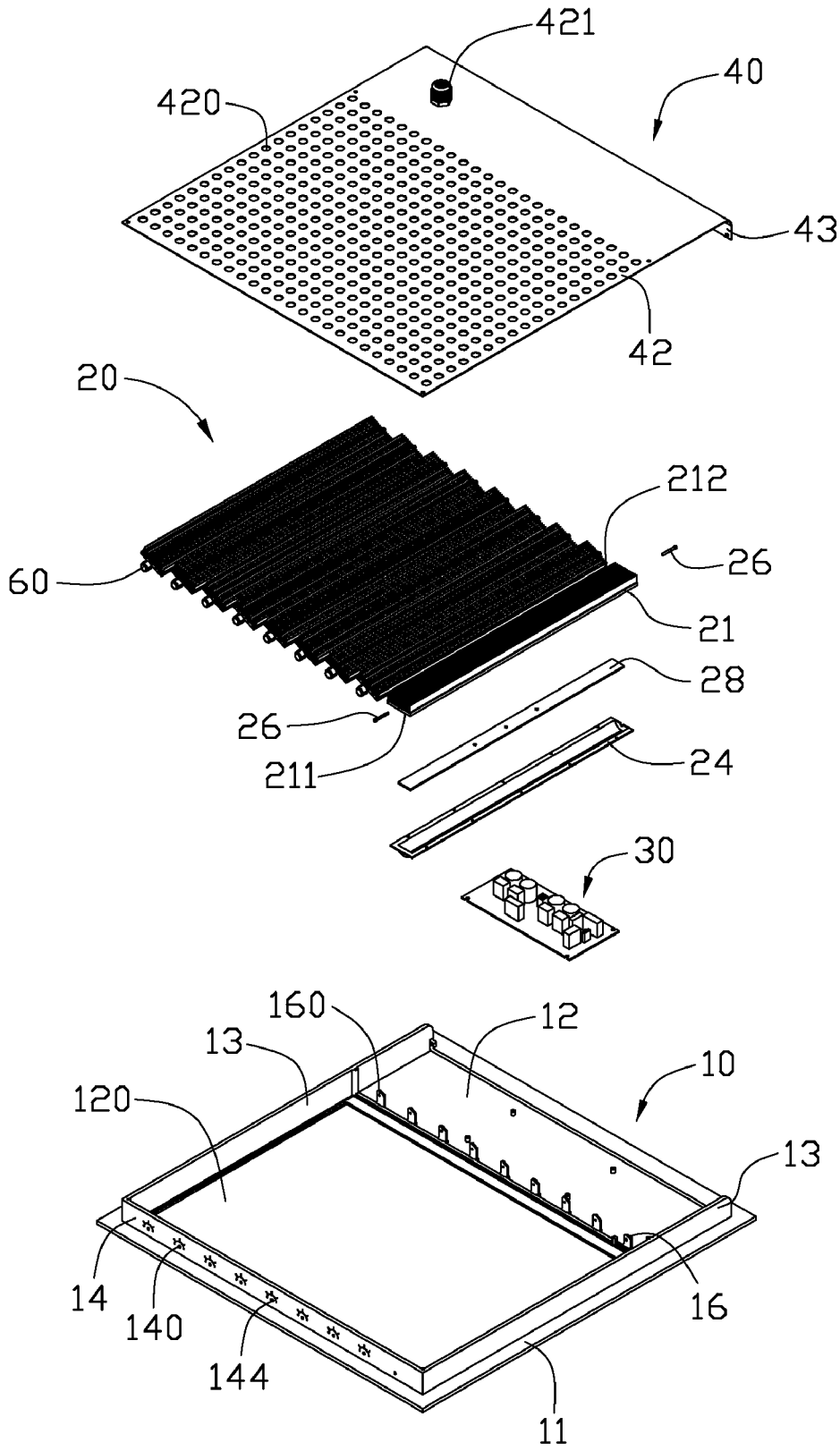
FIG. 1 is an isometric, exploded view of an LED lamp in accordance with an embodiment of the disclosure.
Figure 2:
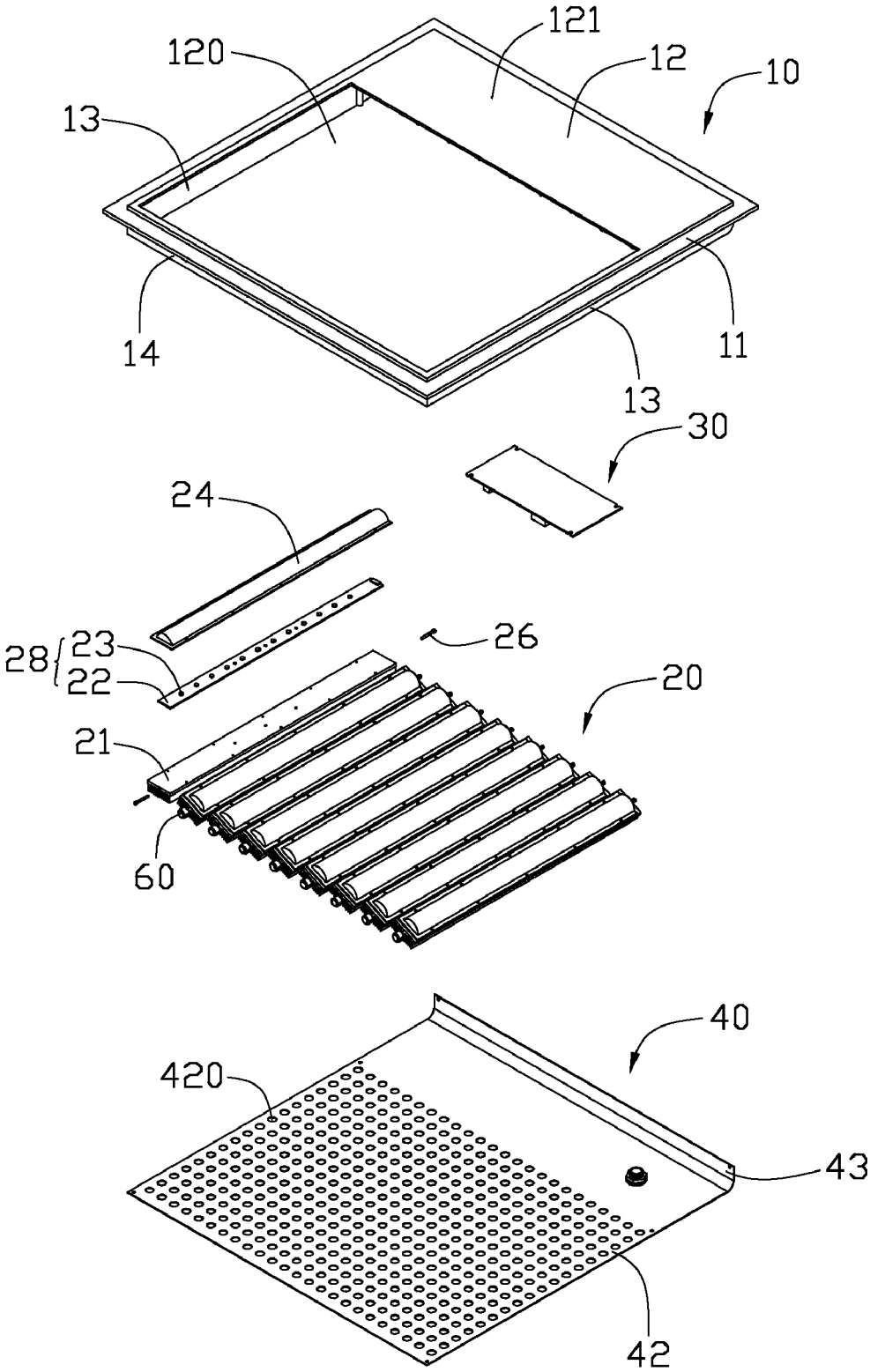
FIG. 2 is an inverted view of the LED lamp of FIG. 1.

Referring to FIGS. 1-2, an LED lamp in accordance with an embodiment of the disclosure is shown. The LED lamp comprises a frame 10, a plurality of LED assemblies 20 engaged in the frame 10, a driving circuit module 30 electrically connecting the LED assemblies 20, and a cover 40 mounted on the frame 10 protecting the LED assemblies 20 and the driving circuit module 30.

The frame 10 is rectangular and comprises four interconnecting strips 11 at a bottom thereof, two opposite sidewalls 13 extending upwardly from inner edges of two opposite strips 11, and another sidewall 14 interconnecting the sidewalls 13. The sidewall 14 extends upwardly from an inner edge of a third strip 11. The frame 10 comprises a horizontal panel 12 connecting the inner edges of the strips 11.

The panel 12 has a bottom surface 121 at the bottom of the frame 10 and defines a rectangular opening 120 therein, through which light generated by the LED assemblies 20 passes. The opening 120 is located near the sidewall 14. In this embodiment, opening 120 is two thirds the size of the panel 12. A plurality of protrusions 16 extends upwardly from the panel 12 adjacent to a side of the opening 120 and opposite to the sidewall 14. The protrusions 16 are spaced from each other and located in a straight line parallel to the sidewall 14. Each of the protrusions 16 is rectangular and defines a through mounting hole 160 facing the sidewall 14 to engage one corresponding LED assembly 20. Alternatively, the protrusions 16 can be an integral plate (not shown), defining a plurality of mounting holes therein. The sidewall 14 defines a plurality of through holes 140 corresponding to the mounting holes 160 of the protrusion 16, respectively. A plurality of graduations 144 is defined around corresponding mounting holes 160 in an outer surface of the sidewall 14 for adjusting rotational angles of the LED assemblies 20 relative to the panel 12 of the frame 10. The driving circuit module 30 is mounted on the panel 12 and in the frame 10.

Figure 3:
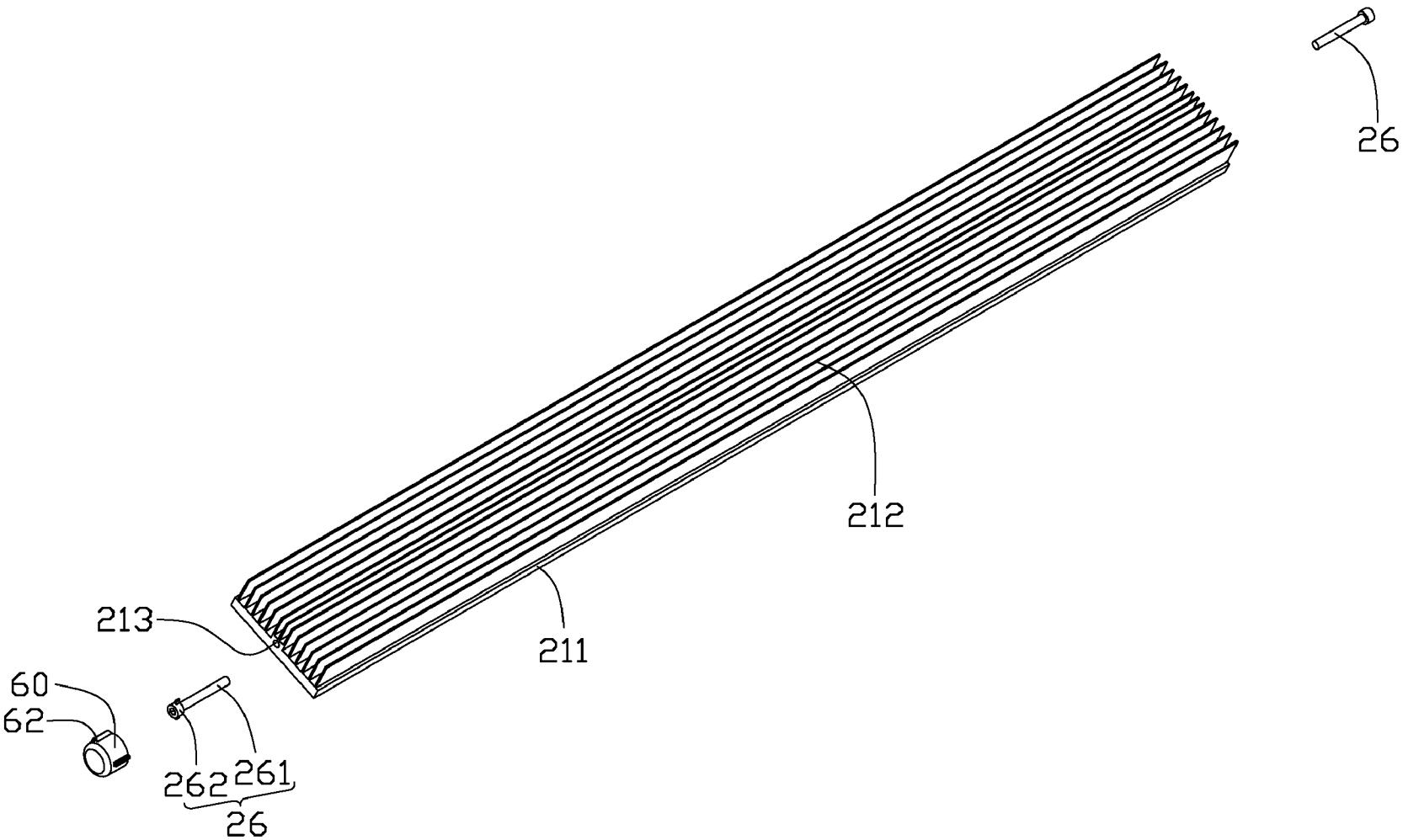
FIG. 3 is an enlarged view of an LED module of the LED lamp of FIG. 1.

Referring also to FIG. 3, each of the LED assemblies 20 comprises a heat sink 21, an LED module 28 engaging the bottom of the heat sink 21 and an envelope 24 engaging the heat sink 21 and covering the LED module 28. The LED module 28 includes a circuit board 22 attached on the heat sink 21 and a plurality of LEDs 23 evenly mounted on the circuit board 22. The heat sink 21 comprises an elongated heat spreader 211 and a plurality of parallel fins 212 extending from a bottom engaging surface 210 of the heat spreader 211. The LED module 28 is mounted on the top surface opposite to the fins 212. Each end of the heat spreader 211 defines a fastening hole 213 at a side face (not labeled) thereof, for fasteners 26 extending the protrusion 16 and the sidewall 14 respectively, and engaging with the ends of the heat spreader 211. Thus, the LED assemblies 20 are engaged in the frame 10 and the LEDs 23 face the opening 120 of the panel 12 of the frame 10.

Each of the fasteners 26 comprises a cylindrical post 261 and a head 262 extending from an end of the post 261. A plurality of adjusters 60 engages the heads 262 of the fasteners 26. Each of the adjusters 60 has a cylindrical configuration and defines a bore (not shown) receiving the head 262 of each fastener 26 therein. The adjuster 60 comprises a plurality of engaging ribs 62 radially formed on an outer circumference thereof, for facility an operation of the adjuster 60.

The cover 40 comprises a planar body 42 with an extending portion 43 extending downwardly from a rear lateral side thereof. The body 42 has dimensions corresponding to the frame 10. The body 42 defines a plurality of through holes 420 facing the LED assemblies 20 and the opening 120 of the frame 10, allowing cooling air moving downward through the through holes 420 to reach the heat sink 21 and then exit the frame 10 via the opening 120. The body 42 engages a joint 421, through which electrical wires (not shown) extend to electrically connect with the driving circuit module 30.

Figure 4:
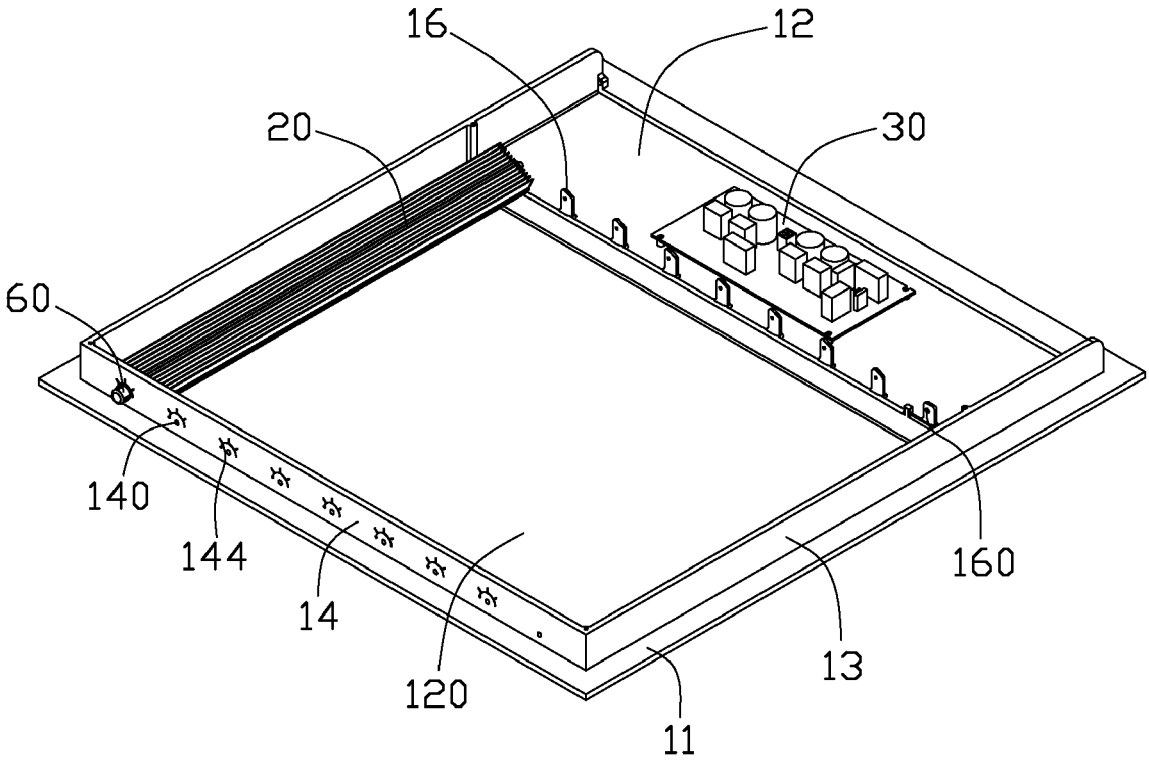
FIG. 4 is a partially assembled view of the LED lamp of FIG. 1.
Figure 5:
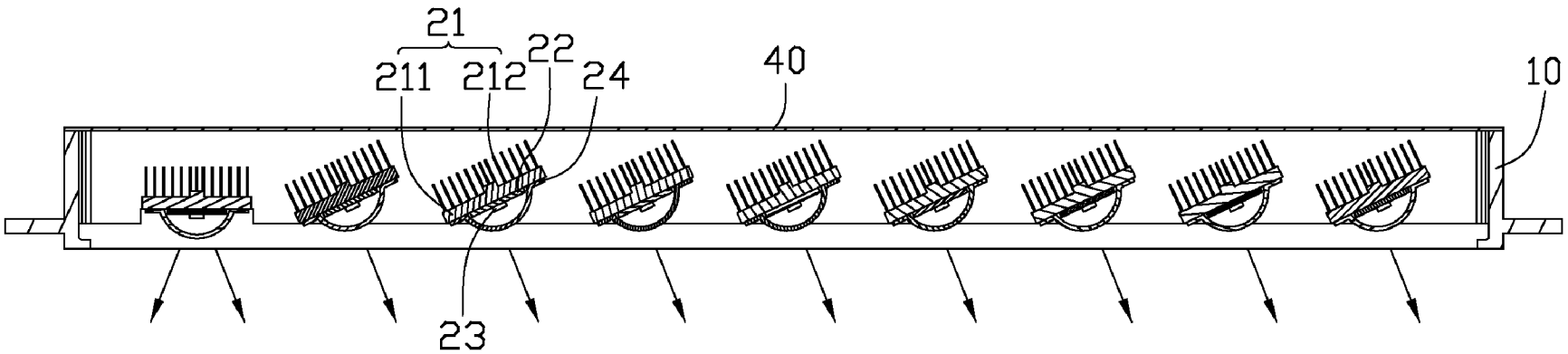
FIG. 5 is an assembled cross section of the LED lamp of FIG. 1.

Also referring to FIGS. 4-5, during assembly of the LED lamp, the LED assemblies 20 span on the opening 120 and engage the sidewall 14 and the protrusions 16 via the fasteners 26. The LED assemblies 20 are rotatable relative to the panel 12 of the frame 10 via rotation of the adjusters 60. According to different requirements of illumination area and illumination intensity, the LED assemblies 20 can be adjusted to a suitable angle relative to the frame 10. The engaging surface 210 of the heat sink 21 with the LED module 28 mounted thereon is adjusted to have an acute angle relative to the bottom surface 121 of the panel 12 of the frame 10. The LED assemblies 20 are mounted in this position by resistance between the sidewall 14 and the adjusters 60. The graduations 144 display different angles to which each LED assembly 20 correspondingly rotates.

It is understood that the quantity of LED assemblies 20 which are rotated is variable according to different demands of desired area and intensity; thus, other LED assemblies 20 which need not rotate are located parallel to the panel 12 of the frame 10. To obtain a suitable illumination area and illumination intensity, requisite LED assemblies 20 are determined. Thus, the LED lamp has an improved selection of illumination area and illumination intensity.

Figure 6:
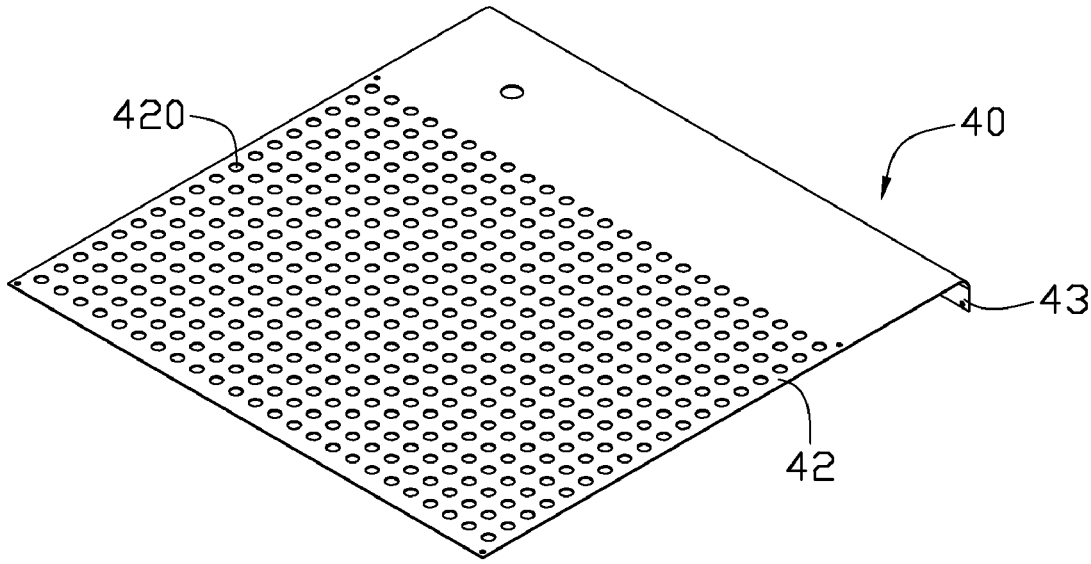
FIG. 6 is a partially assembled view of an LED lamp in accordance with another embodiment of the disclosure.
Figure 6:
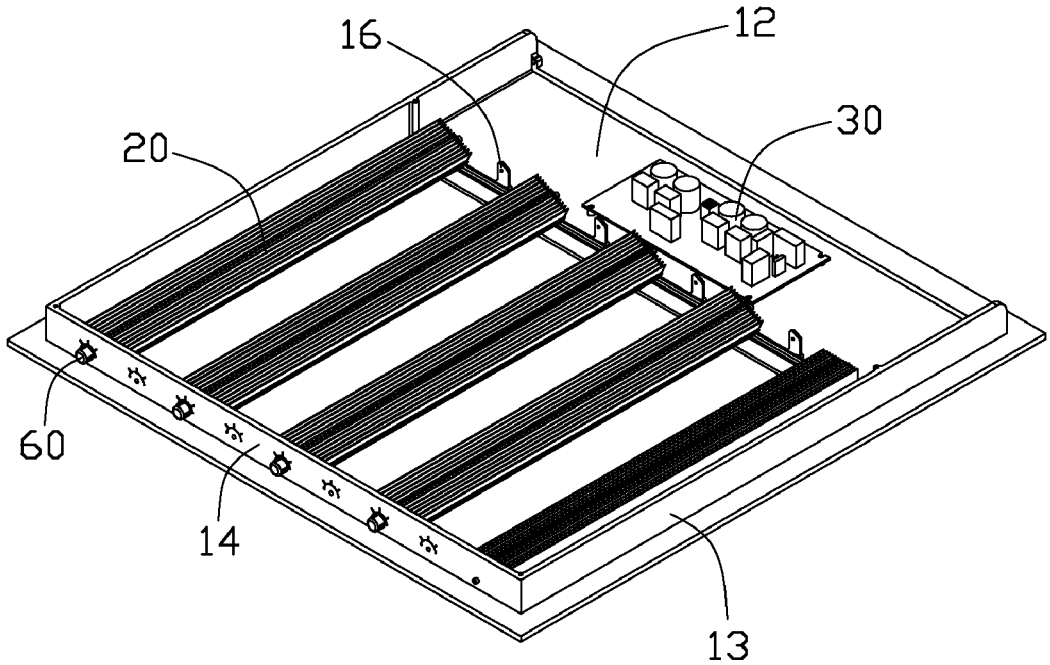

Referring also to FIG. 6, an LED lamp in accordance with another embodiment of the disclosure is shown, differing from the previous embodiment only in that the quantity of LED assemblies 20 is five, rather than nine. The reduced LED assembly count reduces the cost of the LED lamp, and is suited for applications requiring less illumination.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A light emitting diode (LED) lamp comprising:

a frame comprising a bottom surface; and a plurality of heat sinks, each comprising an engaging surface defined at an acute angle with respect to the bottom surface of the frame; and a plurality of LED modules each attached on the engaging surface of the heat sink;

wherein the heat sinks are rotatable relative to the frame to adjust the angle of the engaging surface of each of the heat sinks with respect to the bottom surface of the frame.

2. The LED lamp as claimed in claim 1, wherein the frame comprises a sidewall with which each of the heat sinks has an end pivotally engaged.

3. The LED lamp as claimed in claim 2, wherein the frame comprises a plurality of protrusions opposite to the sidewall with one of which other end of each of the heat sinks is pivotally engaged.

4. The LED lamp as claimed in claim 3, wherein the ends of each of the heat sinks engage the sidewall and the protrusions via two fasteners.

5. The LED lamp as claimed in claim 3, wherein the fame comprises four interconnecting strips and a panel connecting the inner edges of the strips, the sidewall extending from a strip and the protrusions extending from the panel and parallel to the sidewall.

6. The LED lamp as claimed in claim 5, wherein the panel defines an opening between the sidewall and the protrusions, the heat sinks and the LED modules spanning the opening.

7. The LED lamp as claimed in claim 2, wherein the sidewall defines a plurality of graduations corresponding to the heat sinks providing adjustment of the angle of the engaging surface of the heat sinks.

8. The LED lamp as claimed in claim 1, further comprising a cover engaging the frame, the cover defining a plurality of holes relative to the heat sinks.

9. The LED lamp as claimed in claim 1, further comprising another heat sink and another LED module mounted thereon, comprising an engaging surface parallel to the bottom surface of the frame.

10. A light emitting diode (LED) lamp comprising:

a frame comprising a bottom surface; and a plurality of LED assemblies, each comprising an engaging surface and an LED module attached thereto;

wherein the LED assemblies are rotatable relative to the frame to adjust the angle of the engaging surface of the LED assemblies with respect to the bottom surface of the frame.

11. The LED lamp as claimed in claim 10, further comprising a plurality of adjusting buttons engaging the fasteners to adjust the angles of the engaging surfaces of the LED assemblies.

12. The LED lamp as claimed in claim 10, wherein the engaging surfaces of the LED assemblies are parallel.

13. The LED lamp as claimed in claim 12, further comprising another LED assembly having an engaging surface parallel to the bottom surface of the frame, to which another LED module is attached.

* * * * *